US008774670B2

(12) United States Patent
Nishimura

(10) Patent No.: US 8,774,670 B2
(45) Date of Patent: Jul. 8, 2014

(54) IMAGE FORMING APPARATUS THAT PREVENTS IMAGE DELETION

(75) Inventor: Shunsuke Nishimura, Tokyo (JP)

(73) Assignee: Canon Kabushiki Kaisha (JP)

( * ) Notice: Subject to any disclaimer, the term of this patent is extended or adjusted under 35 U.S.C. 154(b) by 155 days.

(21) Appl. No.: 13/367,489

(22) Filed: Feb. 7, 2012

(65) Prior Publication Data

US 2012/0201562 A1 Aug. 9, 2012

(30) Foreign Application Priority Data

Feb. 7, 2011 (JP) ..... 2011-023866

(51) Int. Cl.
*G03G 15/02* (2006.01)

(52) U.S. Cl.
USPC ..... 399/89; 399/75

(58) Field of Classification Search
USPC ..... 399/75, 89
See application file for complete search history.

(56) References Cited

U.S. PATENT DOCUMENTS 5,504,560 A * 4/1996 Kitagaki et al. ..... 399/168

FOREIGN PATENT DOCUMENTS

JP 2007-072212 A 3/2007
JP 2007-072212 A * 3/2007 ..... G03G 21/00

* cited by examiner

*Primary Examiner* — Clayton E Laballe
*Assistant Examiner* — Jas Sanghera
(74) *Attorney, Agent, or Firm* — Rossi, Kimms & McDowell LLP

(57) ABSTRACT

An image forming apparatus that can prevent image deletion in carrying out image formation upon turning-on of power supply after main power supply is turned off before the image forming apparatus goes into a sleep state. A movable member is moved between a shielding position at which it shields a photosensitive drum from a charger and a retracting position at which the photosensitive drum and the charger are opened to each other. When power supply is turned on, a time period for which the photosensitive drum is rotated by a driving unit is controlled according to the position of the movable member detected by a movable member sensor.

5 Claims, 4 Drawing Sheets

IMAGE FORMING APPARATUS THAT PREVENTS IMAGE DELETION

BACKGROUND OF THE INVENTION

1. Field of the Invention

The present invention relates to an image forming apparatus such as a copier, a facsimile, or a printer.

2. Description of the Related Art

In general, in image forming apparatuses using an electrophotographic process, a surface of an image carrier such as a photosensitive member is uniformly charged, and then an electrostatic latent image is formed on the image carrier by exposing the image carrier to light according to image data.

In such image forming apparatuses, when the image carrier is charged using mainly a corona charger. The corona charger charges the image carrier by applying high voltage to a metallic wire to cause corona discharge.

On the other hand, stains inevitably become attached to the metallic wire itself due to corona discharge, and it is thus necessary to clean the metallic wire on a regular basis. Further, the metallic wire may be required to be replaced. Moreover, a large amount of ozone is produced due to corona discharge.

An electrophotographic photosensitive member is affected by ozone product (discharging or charging product) generated by reaction of ozone produced from a charger and moisture in the air, and hence when repeatedly used, the surface of the electrophotographic photosensitive member gradually becomes sensitive to humidity and tends to absorb moisture.

As described above, when ozone product becomes attached to the surface of the photosensitive member which have become sensitive to humidity, the surface resistance of the photosensitive member decreases due to ozone product, and so-called image deletion occurs in which an electrostatic latent image is deleted.

To prevent such image deletion, there has been proposed the technique that a photosensitive member is shielded from a charger when an image forming apparatus switches from a standby state of being ready to form images into a sleep state which is a power saving mode (see Japanese Laid-Open Patent Publication (Kokai) No. 2007-72212). Here, when the image forming apparatus switches into the sleep state, the photosensitive member and the charger are shielded from each other so that ozone product can be prevented from becoming attached to the photosensitive member and deteriorating the durability of the photosensitive member and causing image deletion.

However, according to Japanese Laid-Open Patent Publication (Kokai) No. 2007-72212, if a user turns off main power supply to the image forming apparatus before the image forming apparatus switches from the standby state into the sleep state, the photosensitive member and the charger cannot be shielded from each other.

When the image forming apparatus is left in the state in which the photosensitive member and the charger are not shielded from each other, ozone product becomes attached to the photosensitive member. In this state, if main power supply is turned on, and a print job is executed, image deletion occurs during the execution of the print job because ozone product is attached to the photosensitive member.

SUMMARY OF THE INVENTION

The present invention provides an image forming apparatus that can prevent image deletion in carrying out image formation upon turning-on of power supply after main power supply is turned off before the image forming apparatus goes into a sleep state.

Accordingly, a first aspect of the present invention provides an image forming apparatus comprising a charging unit configured to charge a surface of a photosensitive member, a driving unit configured to rotatively drive the photosensitive member, a shielding member configured to shield the photosensitive member from the charging unit, a moving unit configured to move the shielding member between a shielding position at which the shielding member shields the photosensitive member from the charging unit and a retracting position at which the photosensitive member and the charging unit are opened to each other, a detection unit configured to detect a position of the shielding member, and a control unit configured to, when power supply is turned on, control a time period for which the photosensitive member is rotated by the driving unit according to the position of the shielding member detected by the detection unit.

Accordingly, a second aspect of the present invention provides an image forming apparatus comprising a charging unit configured to charge a surface of a photosensitive member, a driving unit configured to rotatively drive the photosensitive member, a shielding member configured to shield the photosensitive member from the charging unit, a moving unit configured to move the shielding member between a shielding position at which the shielding member shields the photosensitive member from the charging unit and a retracting position at which the photosensitive member and the charging unit are opened to each other, a detection unit configured to detect a position of the shielding member, and a control unit configured to, in a case where the detection unit detects that the shielding member being not at the shielding position when power supply is turned on, carry out an operation to remove charging product attached to the photosensitive member.

According to the present invention, even in the case where power supply is turned off when the shielding member lies at such a position as not to shield the photosensitive member and the charger, and charging product becomes attached to the photosensitive member, the photosensitive member can be heated by heat from the fixing unit and dried by rotating for the second time period longer than the normal rotation time period (the first time period) when power supply is turned on next time, so that the charging product attached to the photosensitive member can be easily peeled and removed.

Further features of the present invention will become apparent from the following description of exemplary embodiments (with reference to the attached drawings).

DESCRIPTION OF THE EMBODIMENTS

A description will now be given of an exemplary image forming apparatus according to an embodiment of the present invention with reference to the drawings.

Figure 1:
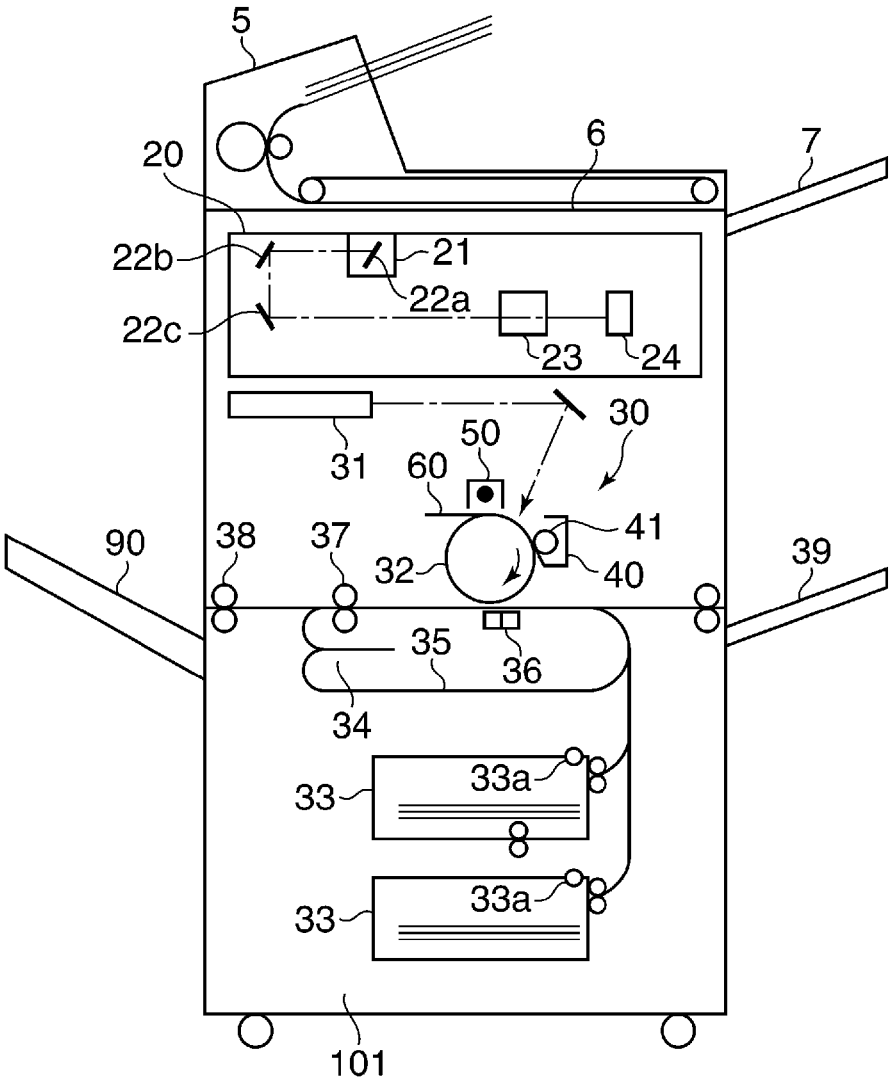
FIG. 1 is a cross-sectional view schematically showing an exemplary image forming apparatus according to an embodiment of the present invention.

FIG. 1 is a cross-sectional view schematically showing the exemplary image forming apparatus according to the embodiment of the present invention.

Referring to FIG. 1, the image forming apparatus 101 has an image reader 20 and a printer 30, and reads an image on an original by the image reader 20 to obtain image data. Then, the printer 30, which is an image forming unit, forms an image according to the image data.

The image forming apparatus has a standby state of being ready to immediately carry out image formation (printing), and a sleep state in which power consumption is less than in the standby state.

An original feeding unit 5 is mounted on the image reader 20. The original feeding unit 5 conveys originals placed facing upward on an original tray one by one from the first page, and feeds the originals onto a platen glass 6 via a curved path. Then, the originals are conveyed rightward via a reading position on the platen glass 6, and discharged onto an external discharged sheet tray 7. The original is read by the image reader 20 when passing through a moving reading position.

For example, the image reader 20 has a scanner unit 21, mirrors 22*a*, 22*b*, and 22*c*, a lens 23, and an image sensor 24. The scanner unit 21 is held at a position corresponding to the moving reading position, and the original is read by the scanner unit 21 when passing through the moving reading position. This reading method is generally referred to as an original moving reading method.

Specifically, when the original passes through the moving reading position, a scanned-in surface of the original is irradiated with light from a lamp (not shown) of the scanner unit 21. Then, reflected light from the original is guided to the lens 23 via the mirrors 22*a*, 22*b*, and 22*c*. The light having passed through the lens 23 forms an image on an imaging surface of the image sensor 24.

By conveying an original through the moving reading position as described above, the original is scanned in a main scanning direction, which is perpendicular to the direction in which the original is conveyed, and a sub scanning direction which is the direction in which the original is conveyed. Namely, when the original passes through the moving reading position, an image on the original is read line by line in the main scanning direction by the image sensor 24 while the original is conveyed in the sub scanning direction so that the entire image on the original can be read.

An optically-read image is converted into an image signal by the image sensor 24 and output. The image signal output from the image sensor 24 is subjected to predetermined processing by an image signal control unit, to be described later, and then supplied as a video signal (also referred to as image data) to an exposure control unit 31 provided in the printer 30.

It should be noted that when an original is to be continuously read, the original may be conveyed onto the platen glass 6 by the original feeding unit 5 and stopped at a predetermined position, and in this state, the scanner unit 21 may scan the original from left to right as viewed in the figure. This reading method is a so-called stationary original reading method.

To read an original without using the original feeding unit 5, the user lifts the original feeding unit 5 and mounts the original on the platen glass 6. Then, the scanner unit 21 is caused to scan the original from left to right as viewed in the figure. Namely, even when an original is to be read without using the original feeding unit 5, the stationary original reading is carried out.

The exposure control unit 31 provided in the printer 30 modulates and outputs laser light based on a video signal (image data). The laser light is irradiated onto a photosensitive drum 32, which is an image carrier, while being scanned by a polygon mirror, not shown. An electrostatic latent image corresponding to the scanned laser light is then formed on the photosensitive drum 32. Here, at the time of stationary original reading, the exposure control unit 31 outputs laser light so as to form an image which is not a mirror image.

The printer 30 has a plurality of sheet feeding cassettes 33 in which sheets on which images are to be formed are stored. The plurality of sheet feeding cassettes 33 can be drawn frontward as viewed in the figure.

When images are to be formed, sheets are fed one by one from the sheet feeding cassettes 33 to an image forming position by separating sheet feeders 33*a* provided for the respective sheet feeding cassettes 33. The printer 30 also has an inversion path 34 for so-called double-sided copying, and when an image is to be formed on a rear side of a sheet with an image formed on one side thereof, the sheet is fed to the inversion path 34. The sheet is then inverted by the inversion path 34 and supplied to the image forming position again by a double-sided conveying path 35.

A primary charger 50 (charging unit: charger), a developing device 40 (developing unit: developer), a transfer device 36, and a shielding member 60 are disposed around the photosensitive drum 32. In the example shown in the figure, the photosensitive drum 32 is made of amorphous silicon. First, voltage is applied to the primary charger 50 to uniformly charge the surface of the photosensitive drum 32 to a predetermined charging potential. The primary charger 50 uniformly charges the surface of the photosensitive drum 32 by corona discharge.

Then, the exposure control unit 31 (exposure unit) carries out exposure to form an electrostatic latent image on the photosensitive drum 32 so that the potential of an image portion on the charged photosensitive drum 32 can be made equal to a predetermined exposure potential. Based on image data, the exposure control unit 31, for example, performs control to turn on or off a semiconductor laser to form an electrostatic latent image corresponding to the image data on the photosensitive drum 32.

The developing unit 40 has a developing roller 41, which is always in contact with the photosensitive drum 32. At the time of development, a high-voltage bias is applied to the developing roller 41 to develop an electrostatic latent image on the photosensitive drum 32 with toner to obtain a toner image.

In synchronization with the start of laser light irradiation, a sheet is fed from the sheet feeding cassette 33 or the double-side conveying path 35 to the image forming position (transfer position). The transfer position is a nip between the photosensitive drum 32 and the transfer device 36. At the transfer position, a toner image formed on the photosensitive drum 32 is transferred to a sheet by the transfer device 36.

The sheet (recording material) onto which the toner image has been transferred is fed to a fixing unit 37 (fixing unit) controlled by a fixing control unit, to be described later. The fixing unit 37 heats and pressurizes the sheet to fix the toner image on the sheet. The sheet having passed through the fixing unit 37 is discharged from the printer 30 onto a discharged sheet tray 90 by discharging rollers 38.

When the sheet is to be discharged with its image forming surface (printing surface) down (face down), the sheet having passed the fixing unit 37 is guided once into the inversion path 34 by switching a flapper (not shown) provided at a branch from the inversion path 34. Then, after the rear end of the sheet passes the flapper, the sheet is switched back and discharged from the printer 30 onto the discharged sheet tray 90 via the discharging rollers 38. This discharging mode will hereafter be referred to as inverted sheet discharge.

The inverted sheet discharge is carried out when images are to be formed sequentially from the first page, for example, in a case where images are formed according to image data obtained as a result of reading originals using the original feeding unit 5 or a case where images are formed according to image data output from a computer (not shown), and after the sheet discharge, the sheets are in page order.

A hard sheet such as an OHP sheet is supplied from a manual sheet feeding unit 39 appearing in FIG. 1, and when an image is to be formed on the sheet, the sheet is not guided to the inversion path 34 but is discharged with its image forming surface facing upward (face up) onto the discharged sheet tray 90 via the discharging rollers 38. Thus, a sheet tending to be jammed such as a hard sheet is discharged with its face up.

When double-sided recording (double-sided copying) in which images are formed on both sides of a sheet is set, the sheet is guided once to the inversion path 34 by switching the flapper provided at the branch from the inversion path 34 and then conveyed to the double-sided conveying path 35. The sheet guided to the double-sided conveying path 35 is fed again to the nip (transfer position) between the photosensitive drum 32 and the transfer device 36 with predetermined timing.

Figure 2:
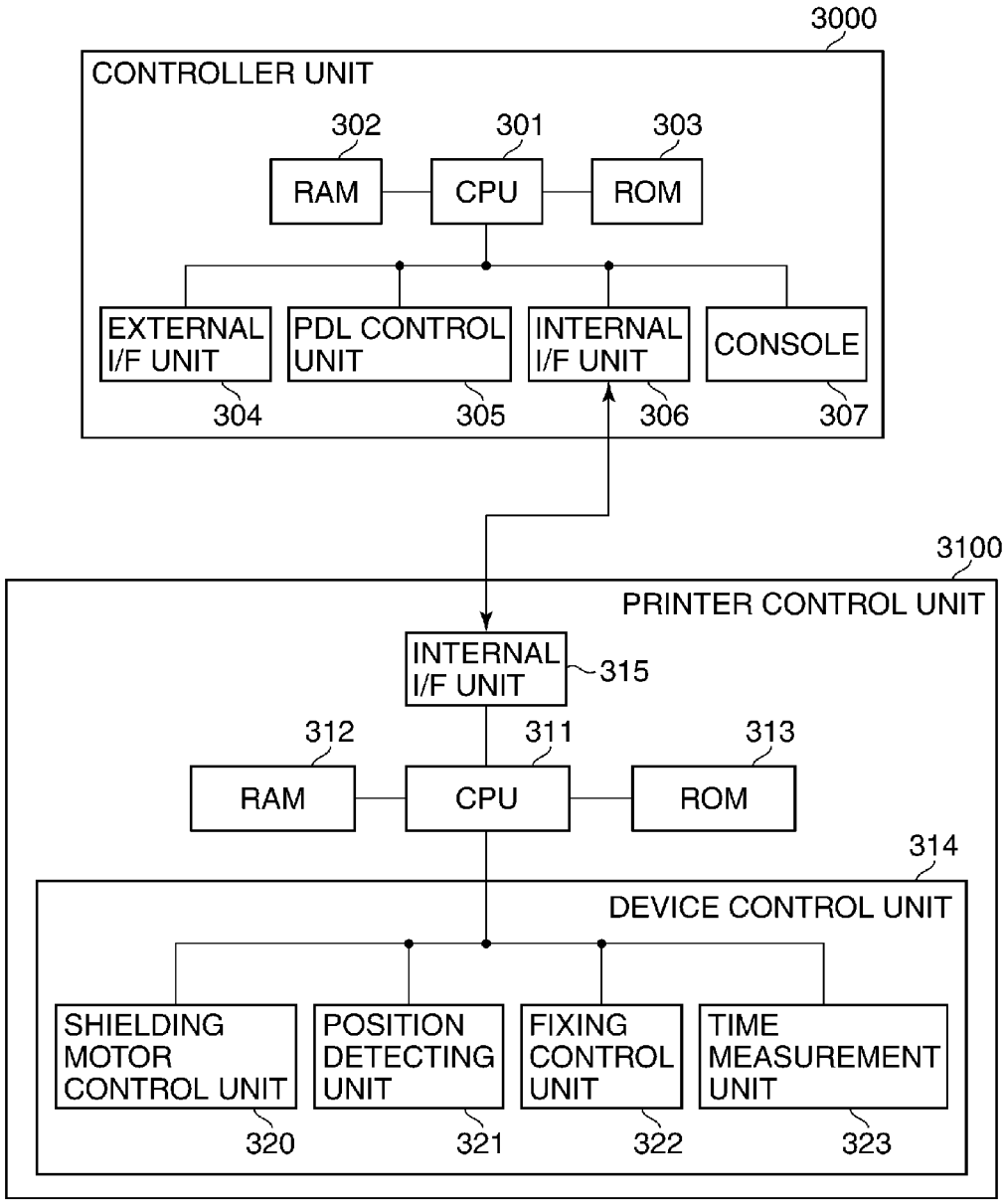
FIG. 2 is a block diagram useful in explaining a control system of the image forming apparatus appearing in FIG. 1.

FIG. 2 is a block diagram useful in explaining a control system of the image forming apparatus 101 appearing in FIG. 1.

Referring to FIG. 2, the image forming apparatus 101 has a controller unit 3000 and a printer control unit 3100. The controller unit 3000 manages jobs such as print jobs, and the printer control unit 3100 controls the printer 30. Namely, the printer control unit 3100 forms a toner image according to image data on a sheet and controls conveyance of the sheet.

The controller unit 3000 has a CPU 301, a RAM 302, a ROM 303, an external interface (I/F) unit 304, a PDL (page description language) control unit 305, an internal I/F unit 306, and a console 307. The ROM 303 stores control programs operating on the CPU 301, and RAM 302 is used as a work area for the CPU 301 and stores, for example, data (image data) processed by the CPU 301. The ROM 303 and the RAM 302 are connected to the CPU 301 by an address bus or a data bus.

The external I/F unit 304 is an interface for communicating with external apparatuses such as a PC. The PDL control unit 305 processes, accumulates, and performs image processing on received data. The internal I/F unit 306 is an interface for communicating with the printer control unit 3100.

The CPU 301 displays various information on the console 307 and accepts key input to the console 307. The user instructs the CPU 301 to switch displays on the console 307 by operating the console 307 (key input). The CPU 301 displays information on the operating state of the image forming apparatus 101 and operation modes set by key input.

The printer control unit 3100 has a CPU 311, a RAM 312, a ROM 313, a device control unit 314, and an internal I/F unit 315, and is connected to the controller unit 3000 by the internal I/F unit 315.

The CPU 311 performs basic control associated with image formation in accordance with control programs stored in the ROM 313. The RAM 312 is used as a work area for the CPU 311 and stores data for use in image formation (image data). The ROM 313 and the RAM 312 are connected to the CPU 311 by an address bus and a data bus. It should be noted that control procedures and others are stored in the ROM 313.

The device control unit 314 has a shielding motor control unit 320, a position detection unit 321, a fixing control unit 322, and a time measurement unit 323. The device control unit 314 controls the printer 30. The internal I/F unit 315 sends and receives image data and timing signals to and from the controller unit 3000. Namely, the device control unit 314 receives image signals from the controller unit 3000, and controls the printer 30 in accordance with control programs to carry out image formation.

It should be noted that the shielding motor control unit 320 controls a shielding motor (not shown) that dives a shielding member (not shown) for shielding the photosensitive drum 32 from the primary charger 50. The position detection unit 321 detects the position of the shielding member (detection unit). The fixing control unit 322 controls the fixing unit 37.

Figure 3:
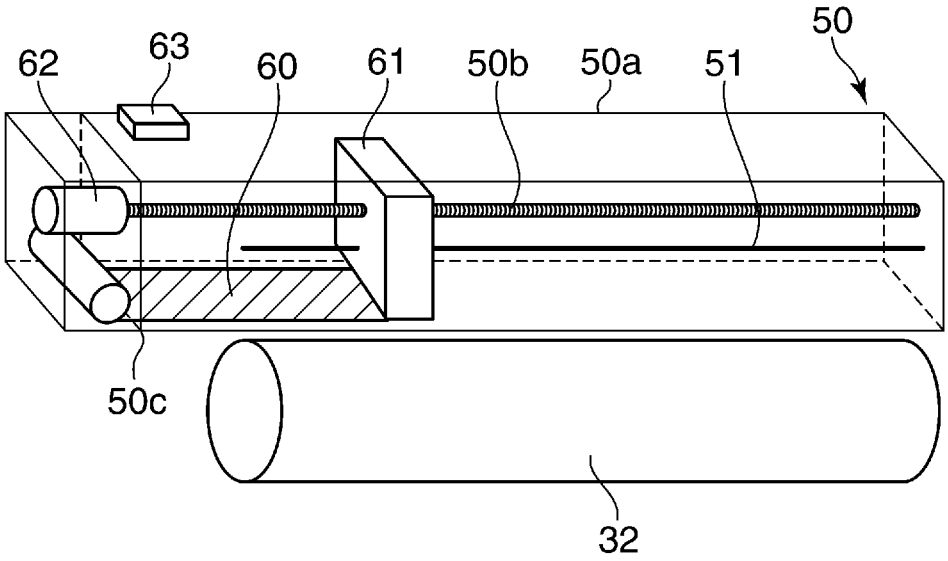
FIG. 3 is a perspective view showing an interior of a primary charger appearing in FIG. 1 so as to explain an arrangement of the primary charger.

FIG. 3 is a perspective view showing an interior of the primary charger 50 appearing in FIG. 1 so as to explain the arrangement of the primary charger 50.

Referring to FIG. 3, the primary charger 50 has a charger casing 50*a* whose one side thereof on the photosensitive drum 32 side is opened. A charging wire (metallic wire) 51, a shielding member 60, a movable member 61, and a shielding motor 62 are housed in the charger casing 50*a*.

One end of the shielding member 60 is mounted on one end face of the movable member 61. In the example shown in the figure, the shielding member 60 is sheet-shaped, and drawn from a winding frame in response to movement of the movable member 61 to close the opening surface of the charger casing 50*a* described above. As shown in the figure, an inner space of the charger casing 50*a* is partitioned into first and second chambers by a partition plate 50*c*, and the winding frame and the shielding motor 62 are disposed in the first chamber.

The shielding member 60 extends from a lower end of the partition plate 50*c* to the second chamber. It should be noted that as shown in the figure, the charging wire 51 is disposed in the second chamber, and its length (the length of the charger casing 50*a* in a longitudinal direction) is greater than the length of the photosensitive drum 32 in an axial direction. The charging wire 51 penetrates the movable member 61, and hence the movement of the movable member 61 is not inhibited by the charging wire 51.

A screw axial member 50*b* extending in the longitudinal direction of the charger casing 50*a* is mounted on a rotary shaft of the shielding motor 62, and the screw axis member 50*b* penetrates and engages with the movable member 61. As a result, rotatively driving the shielding motor 62 causes the movable member 61 engaged with the screw axis member 50*b* to move in the longitudinal direction of the charger casing 50*a*, and accordingly, the shielding member 60 is drawn out from the winding frame to close the opening. Thus, the photosensitive drum 32 is shielded from the charging wire 51 by the shielding member 60.

A movable member sensor 63 (position detection unit) for detecting the position of the movable member 61 is mounted on the charger casing 50*a*. The movable member 61 moves between a retracting position and a shielding position prescribed in advance, and the movable member sensor 63 is disposed at such a position as to detect the movable member 61 when the movable member 61 is at the retracting position.

It should be noted that the movable member sensor 63 may be disposed at such a position as to detect the movable member 61 when the movable member 61 is at the shielding position. The movable member sensor 63 has only to be disposed at such a position as to detect the movable member 61 when the movable member 61 is at the shielding position or the retracting position.

Here, when the movable member 61 is at the shielding position, the photosensitive drum 32 is shielded from the charging wire 51, and when the movable member 61 is at the retracting position determined in advance, the charging wire 51 and the photosensitive drum 32 are opened to each other.

Figure 4:
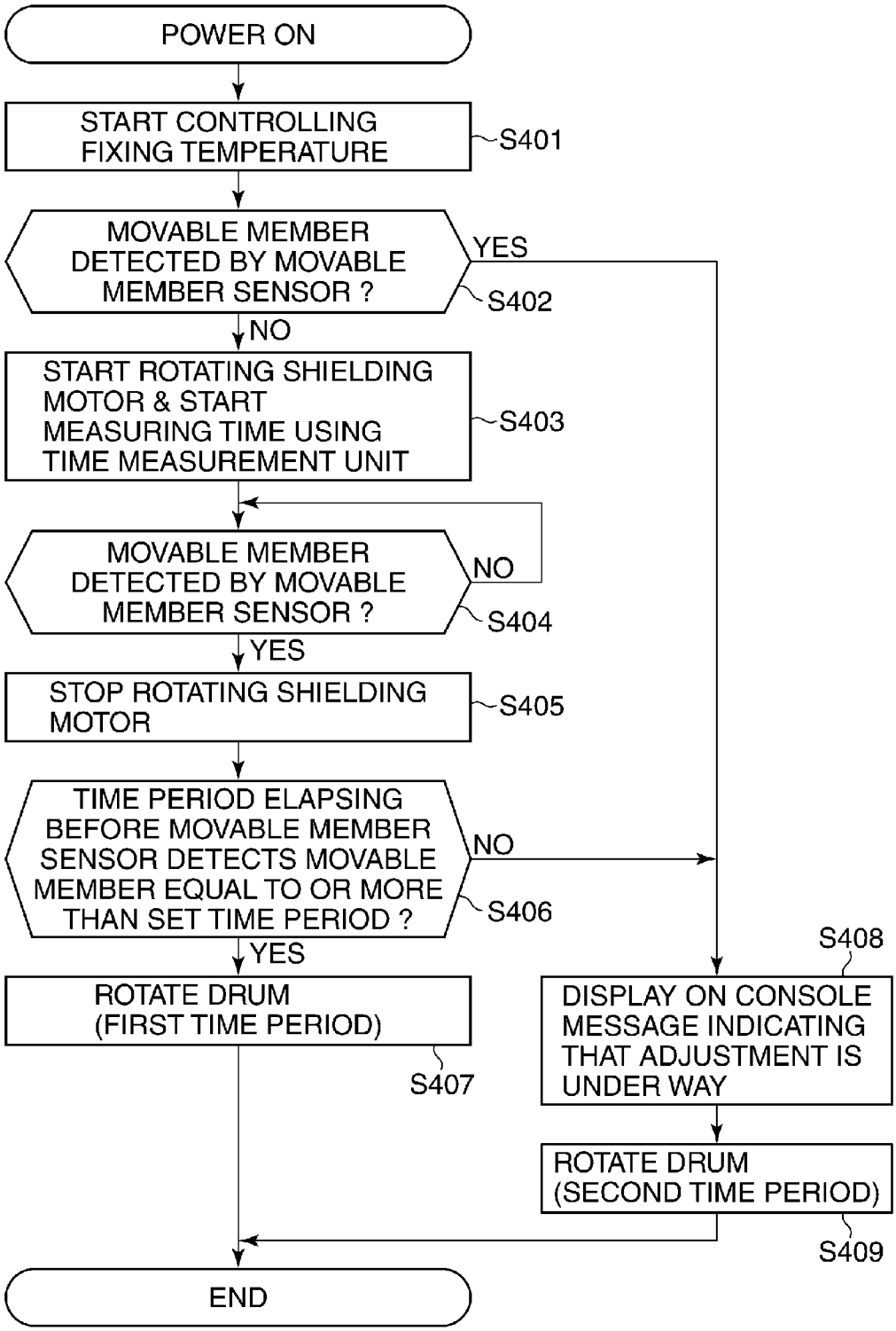
FIG. 4 is a flowchart useful in explaining control to remove charging product (ozone product) in the image forming apparatus appearing in FIG. 1.

FIG. 4 is a flowchart useful in explaining control to remove charging product (ozone product) in the image forming apparatus 101 appearing in FIG. 1.

Referring to FIGS. 1 to 4, now, when power supply is turned on (the power is turned on) in the image forming apparatus 101, the CPU 311 controls the fixing control unit 322 to cause the fixing control unit 322 to operate a heater (not shown). Namely, the fixing control unit 322 starts heating the fixing unit 37 to control the temperature of the fixing unit 37 (step S401).

Then, the CPU 311 determines via the position detection unit 321 whether or not the movable member 61 is detected by the movable member sensor 63 (step S402). When the movable member 61 is not detected by the movable member sensor 63 (NO in the step S402), that is, when the movable member 61 is at the shielding position, and the shielding member 60 shields the photosensitive drum 32 from the charging wire 51, the CPU 311 causes the shielding motor control unit 320 to rotatively control the shielding member 62 (step S403). Thus, the CPU 311 moves the movable member 61 from the shielding position toward the retracting position.

Further, in step S403, the CPU 311 activates the time measurement unit 323 to start measuring time at the same time when the movable member 61 starts moving. Then, the CPU 311 determines whether or not the movable member 61 is detected by the movable member sensor 63 (step S404). Namely, the CPU 311 determines whether or not the movable member 61 has reached the retracting position.

When the movable member 61 has not reached the retracting position (NO in the step S404), the CPU 311 stands by. On the other hand, when the movable member 61 has reached the retracting position (YES in the step S404), that is, the movable member 61 is detected by the movable member sensor 63, the CPU 311 causes the shielding motor control unit 320 to stop rotating the shielding motor 62 (step S405).

On this occasion, the CPU 311 reads a time period measured by the time measurement unit 323. This time period is a time period from when the movable member 61 starts moving to when the movable member sensor 63 detects the movable member 61 (moving time period), that is, a time period elapsing before the movable member 61 reaches the retracting position. Then, the CPU 311 resets the time measurement unit 323.

Then, the CPU 311 determines whether or not the moving time period is equal to or more than a set time period set in advance (for example, 15 seconds or longer) (step S406). This set time period is set to a time period required for the movable member 61 to move from the shielding position to the retracting position.

When the moving time period is equal to or more than the set time period (YES in the step S406), the CPU 311 determines that before the movable member 61 is caused to start moving, the movable member 61 is at the shielding position, and the photosensitive drum 32 is completely shielded from the charging wire 51. Then, the CPU 311 rotatively drives the photosensitive drum 32 for a normal drum rotation time period (first time period; for example, 10 seconds) (step S407: driving unit) and brings the image forming apparatus 101 into a standby state.

When in the step S402, the movable member 61 is detected by the movable member sensor 63 (YES in the step S402), that is, when the movable member 61 is at the retracting position, and the photosensitive drum 32 is not shielded from the charging wire 51 by the shielding member 60, the CPU 311 determines that power supply is turned off before the shielding member 60 shields the photosensitive drum 32 from the charging wire 51.

In this case, the CPU 311 notifies the controller unit 3000 to that effect via the internal I/F 315. As a result, the CPU 301 displays on the console 307 a message indicating that adjustment is under way (step S408).

Then, the CPU 311 rotatively drives the photosensitive drum 32 for a predetermined rotation time period (second time period; for example, 5 minutes) longer than the normal drum rotation time period (step S409) and brings the image forming apparatus 101 into a standby state. It should be noted that when in the step S406, the moving time period is less than the set time period (NO in the step S406), the CPU 311 determines that before the movable member 61 is caused to move, the movable member 61 was at an intermediate position between the shielding position and the retracting position, and proceeds to step S408.

Thus, when the movable member 61 is not at the shielding position when power supply is turned on, that is, the photosensitive drum 32 is not completely shielded from the charging wire 51 by the shielding member 60, the photosensitive drum 32 is rotated for a longer time period than the normal drum rotation time period. As a result, before the image forming apparatus 101 is brought into a standby state, heat of the fixing unit 37 is given to the photosensitive drum 32 to dry the photosensitive drum 32, while the photosensitive drum 32 is rotated for a longer time period than normal, so that charging product attached to the photosensitive drum 32 can be easily peeled and removed. As a result, image deletion during image formation can be prevented.

As described above, the time period for which the photosensitive drum 32 is rotated is controlled according to the position of the movable member 61, that is, the shielding member 60 and the time period for which the shielding member 60 moves when main power supply is turned on. Thus, even in the case where main power supply is turned off when the shielding member 60 is at such a position as not to shield the photosensitive drum 32 from the charging wire 51 (that is, the charger), and charging product becomes attached to the photosensitive drum 32, the charging product attached to the photosensitive drum 32 can be peeled and removed when main power supply is turned on. As a result, image deletion can be reliably prevented when a print job is executed.

As is clear from the above description, the CPU 311, the shielding motor control unit 320, and the shielding motor act as a moving unit or a moving mechanism. The CPU 311, the position detection unit 321, and the time measurement unit 323 act as a control unit. Further, the CPU 301 and the console 307 act as a display control unit.

Although in the above description, charging product is removed by rotating the photosensitive drum 32 for a longer period of time than normal, charging product should not necessarily be removed in this manner according to the present invention. For example, charging product may be removed by a cleaning member provided so as to clean the surface of the photosensitive drum 32.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-023866 filed Feb. 7, 2011, which is hereby incorporated by reference herein in its entirety.

What is claimed is:

1. An image forming apparatus comprising:

a charging unit configured to charge a surface of a photosensitive member;

a driving unit configured to rotatively drive the photosensitive member;

a shielding member configured to shield the photosensitive member from said charging unit;

a moving unit configured to move said shielding member between a shielding position at which said shielding member shields the photosensitive member from said charging unit and a retracting position at which said photosensitive member and said charging unit are opened to each other;

a detection unit configured to detect a position of said shielding member; and a control unit configured to, when power supply is turned on, control a time period for which the photosensitive member is rotated by said driving unit according to the position of said shielding member detected by said detection unit, wherein when the power supply is turned on, said control unit controls said driving unit to rotate the photosensitive member for a first time period when said detection unit detects said shielding member being at the shielding position, and controls said driving unit to rotate the photosensitive member for a second time period longer than the first time period when said detection unit detects said shielding member being not at the shielding position.

2. An image forming apparatus according to claim 1, further comprising a position detecting unit configured to detect said shielding member being at one of the retracting position and the shielding position.

3. An image forming apparatus according to claim 1, wherein the image forming apparatus has a standby state of being ready to carry out the image formation, and a sleep state in which power consumption is less than in the standby state, and said control unit rotatively drives the photosensitive member for the first time period or the second time period and then brings the image forming apparatus into the standby state.

4. An image forming apparatus according to claim 1, further comprising a time measurement unit configured to, when the power supply is turned on, measure a moving time period elapsing before said shielding member moves to the retracting position, wherein in a case where said shielding member is not at the retracting position when the power supply is turned on, said control unit controls said moving unit to move said shielding member to the retracting position, and activates said time measurement unit to measure the moving time period, and when the measured moving time period is less than a set time period set in advance, controls said driving unit to rotate the photosensitive member for the second time period.

5. An image forming apparatus comprising:

a charging unit configured to charge a surface of a photosensitive member;

a driving unit configured to rotatively drive the photosensitive member;

a shielding member configured to shield the photosensitive member from said charging unit;

a moving unit configured to move said shielding member between a shielding position at which said shielding member shields the photosensitive member from said charging unit and a retracting position at which said photosensitive member and said charging unit are opened to each other;

a detection unit configured to detect a position of said shielding member;

a control unit configured to, when power supply is turned on, control a time period for which the photosensitive member is rotated by said driving unit according to the position of said shielding member detected by said detection unit; and a display control unit configured to, before said control unit rotates the photosensitive member, display a message indicating that the image forming apparatus is to be adjusted.

* * * * *